US005552583A

United States Patent [19]

Berteaud et al.

[11] Patent Number: 5,552,583

[45] Date of Patent: Sep. 3, 1996

[54] MICROWAVE APPLICATOR DEVICE FOR CONTINUOUS HEAT TREATMENT OF ELONGATE PRODUCTS

[75] Inventors: André Berteaud, Draveil; Alain Germain; Michel Delmotte, both of Bourg La Reine, all of France

[73] Assignee: S.A. Microondes Energie Systemes, Fresnes Cedex, France

[21] Appl. No.: 510,517

[22] Filed: Aug. 2, 1995

[30] Foreign Application Priority Data

Aug. 5, 1994 [FR] France ..... 94 09747

[51] Int. Cl.[6] ..... H05B 6/78; H05B 6/72

[52] U.S. Cl. ..... 219/693; 219/696; 219/697; 219/700; 219/746; 219/750; 333/233

[58] Field of Search ..... 219/693, 697, 219/695, 696, 700, 701, 698, 699, 750, 745, 746, 747; 333/230, 231, 232, 233

[56] References Cited

U.S. PATENT DOCUMENTS

| | | | |
|---|---|---|---|
| 3,688,068 | 8/1972 | Johnson | 219/696 |
| 5,278,375 | 1/1994 | Berteaud et al. | 219/693 |
| 5,442,160 | 8/1995 | Kimrey, Jr. et al. | 219/693 |

FOREIGN PATENT DOCUMENTS

| | | | |
|---|---|---|---|
| 0446114 | 9/1991 | European Pat. Off. . | |
| 647898 | 2/1979 | U.S.S.R. | 219/696 |

*Primary Examiner*—Philip H. Leung
*Attorney, Agent, or Firm*—Notaro & Michalos PC

[57] ABSTRACT

A microwave applicator device for continuous heat treatment of elongate products comprises an applicator housing that defines a generally rectangular waveguide cavity and at least one excitation system for exciting the cavity with microwaves propagating in $TE_{01}$ transverse electric mode, the system including at least one microwave generator associated with a feed waveguide connected to the cavity via a window formed through a wall of the cavity. The front and rear walls of the feed waveguide are respectively connected to the front and rear edges of the window, and the feed waveguide is associated with a guide flap extending in the cavity in the vicinity of the rear edge of the window, and with a guide member provided substantially facing the window. The front and rear walls of the feed waveguide include respective front and rear connection portions situated in the connection zone for connection with the window, and each being curved forwards substantially in the form of an arc of a circle, the guide flap is situated substantially in line with the rear connection portion, and the excitation system includes means for adjusting wave coupling.

18 Claims, 2 Drawing Sheets

MICROWAVE APPLICATOR DEVICE FOR CONTINUOUS HEAT TREATMENT OF ELONGATE PRODUCTS

FIELD OF THE INVENTION

The present invention relates to a microwave applicator device for continuous heat treatment of elongate products, the device comprising:

- an applicator housing defining a rectangular waveguide cavity with open longitudinal ends enabling elongate products to pass therethrough;
- drive means for driving said products along the longitudinal direction of the housing;
- at least one excitation system for exciting said cavity with microwaves propagating in $TE_{01}$ transverse electric mode to create an electric field in said cavity and extending along a "first" one of the transverse directions of the cavity, said system including a microwave generator associated with a feed waveguide connected to the cavity via a window formed through a "first" wall of said cavity, said window extending parallel to the first transverse direction, said feed waveguide having two side walls, a rear wall, and a front wall;
- the front and rear walls of the feed waveguide being respectively connected to the front and rear edges of the window;
- the feed waveguide being associated with a guide flap extending inside the cavity in the vicinity of the rear edge of the window, and being associated with a guide member disposed on the inside face of the wall of the cavity opposite to said first wall and being located substantially facing the window.

BACKGROUND OF THE INVENTION

Microwaves cover waves at frequencies lying in the range 0.3 GHz to 300 GHz, and more particularly lying in the 0.3 GHz to 5.2 GHz band.

The forwards direction is defined as being the direction in which the wave propagates in the cavity. Consequently, the front wall of the feed waveguide is defined as the wall which, in the propagation direction, lies downstream, whereas the rear wall is the wall which, in the same direction is upstream.

European patent application EP-A-0 446 114 discloses a device designed for microwave treatment of sheet or foil products in which openings for passing the product are provided in the form of thin slots, and the walls of the feed waveguide are perpendicular to the longitudinal direction of the waveguide cavity.

To deflect the propagation direction of the wave leaving the feed waveguide, there are provided two guide flaps inclined at 45°, together with trapping plates. The two flaps are spaced apart at a very small distance so as to provide almost continuous guidance for the wave, such that it is possible to pass only a product that is in foil or sheet form.

A product in foil or sheet form is a product which has very small size in one of the directions extending transversely to its longitudinal direction.

The term "elongate product" is used herein in general to designate any product of generally uniform section but of arbitrary transverse dimensions. This definition covers elongate products both of whose transverse directions are comparable, such as section bars, or even cylinders or tubes.

Known devices do not enable such elongate products to be treated with an electric field extending perpendicularly to the longitudinal direction because the transverse dimensions of the product are too large to enable it to pass through the thin slots and between the above-mentioned flaps.

OBJECT AND SUMMARY OF THE INVENTION

The present invention seeks to remedy that drawback.

The simple fact of enlarging the slots and of spreading apart the guide flaps would not provide a satisfactory solution in that it would result in $TE_{01}$ propagation mode becoming highly unstable.

That would spoil the effectiveness of the treatment. In addition, when the elongate product includes at least one metal insert, the fact of activating propagation in a mode other than $TE_{01}$ mode, i.e. having an electric field oriented parallel to one of the dimensions of the insert could lead to damage to the product to be treated or to the device and could greatly reduce energy transfer.

The object of the invention is achieved by the facts that the front and rear walls of the feed waveguide include respective front and rear connection portions situated in the connection zone for connection to the window, and each having forward curvature that is substantially in the form of an arc of a circle; that the guide flap is situated substantially in line with the rear connection portion; and that the excitation system includes means for adjusting coupling.

The radius of curvature of the connection portions is large enough to guide the wave emitted by the generator progressively so that it comes to propagate in the propagation direction of the waveguide, while still preserving $TE_{01}$ mode.

The position of the guide flap substantially in line with the rear connection portion ensures that no sharp angle appears in the region of the rear edge of the window. Thus, although the distance between the guide flap and the guide member is greater than the spacing between the guide flaps of conventional devices so as to leave room for the elongate product, there is no tendency for the wave on leaving its feed waveguide to travel round the guide flap so as to propagate in a mode other than $TE_{01}$ mode.

The coupling adjustment means serve to minimize reflection of the wave inside the feed waveguide and at its entrance into the cavity, thereby contributing to maintaining the desired propagation mode.

To reinforce the guidance effect, the guide flap advantageously has curvature that matches that of the rear connection portion; this may also apply to the active face of the guide member.

When an elongate product such as a section bar having transverse dimensions that are of substantially the same order is subjected to a microwave field, and when, as is often the case, the material from which the product is made is highly absorbent, the applied wave is very quickly and very strongly attenuated in its propagation direction.

To remedy that drawback, and to enable such a product to be subjected to effective heat treatment, the device advantageously includes a plurality of excitation systems each comprising an analogous feed waveguide connected to the cavity via a respective window. The windows are formed through the first wall at successive longitudinal positions so that the feed waveguides are disposed in series.

For each excitation system, the front and rear walls of the corresponding feed waveguide include respective front and rear connection portions situated in the connection zone for connection to the window, and each curving forwards substantially over a circular arc, the corresponding guide flap being situated substantially in line with the rear connection portion, and the excitation system including coupling adjustment means.

Because of these dispositions, the waves emitted by the various excitation systems all propagate in $TE_{01}$ mode and do not disturb one another mutually.

BRIEF DESCRIPTION OF THE DRAWINGS

The invention will be better understood and its advantages will appear more clearly on reading the following detailed description of an embodiment given by way of non-limiting example. The description refers to the accompanying drawings, in which.

MORE DETAILED DESCRIPTION

Figure 1:
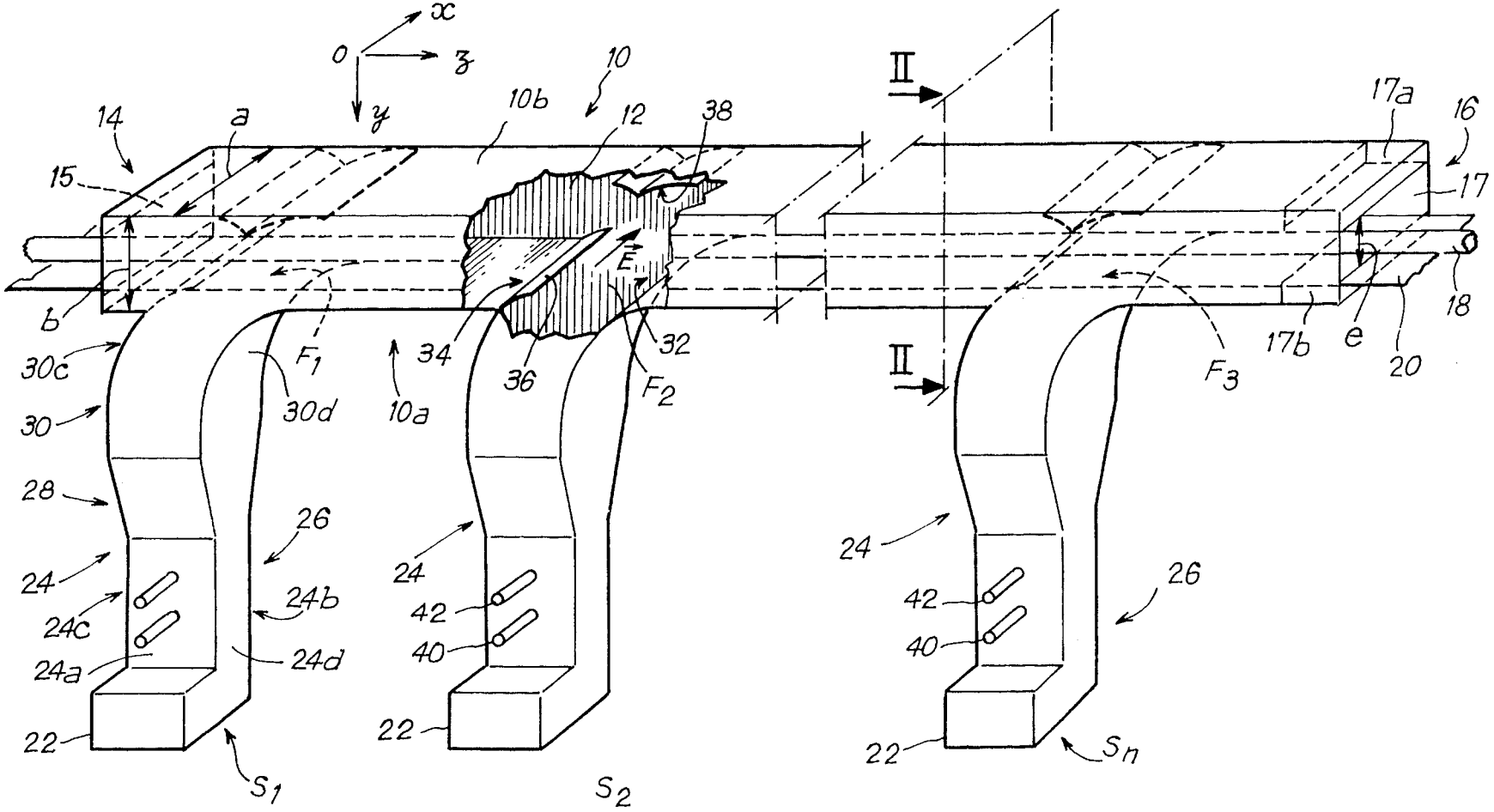
FIG. 1 is a perspective view of a device of the invention.

To facilitate understanding, FIG. 1 shows an orthogonal frame of reference (Ox, Oy, Oz). The cavity is generally in the shape of a rectangular parallelepiped, its long direction being the direction Oz, while its first and second transverse directions are the directions Ox and Oy respectively.

In the cavity, wave propagation takes place in the direction Oz and in transverse electric mode $TE_{01}$, the electric field E being parallel to the first transverse direction Ox.

The longitudinal ends 14 and 16 of the cavity 10 are open so as to enable an elongate product 18 to pass therethrough for the purpose of being subjected to continuous heat treatment.

This elongate product is shown in highly diagrammatic fashion, and may be constituted by any product such as a section bar, i.e. any product that has a longitudinal size that is large and a cross-section that is given.

The device includes means for driving the product 18 in the longitudinal direction Oz of the housing 10.

In the example shown, the direction Oz is horizontal while the direction Oy is vertical, and the drive means may be constituted by an endless belt 20, shown in part.

To clarify the drawing, the elongate product 18 and the endless belt 20 are omitted from the cutaway portion of FIG. 1.

The device includes at least one excitation system for exciting the cavity 12 with microwaves that propagate in transverse electric mode $TE_{01}$.

The number of excitation systems is a function of the duration of the treatment that is to be applied to the elongate product and of the speed at which the product travels along the cavity 12. FIG. 1 is interrupted and only three excitation systems are shown given respective references $S_1$, $S_2$ and $S_n$.

In certain applications there may be only one excitation system $S_1$, whereas in other applications a device may be made in which the number n is relatively large, e.g. about 12.

Each excitation system comprises a microwave generator 22 associated with a feed waveguide 24 connected to the cavity 12 via a window.

The windows $F_1$, $F_2$ and $F_n$ to which the feed waveguides of the systems $S_1$, $S_2$ and $S_n$ are respectively connected are formed through the wall 10*a* of the cavity 12.

In the example shown, the wall 10*a* is the bottom wall of the cavity lying in the plane (Ox, Oz). It would also be possible for the feed waveguides to be connected to the top wall 10*b* of the cavity 12.

As can be seen more clearly in the cutaway portion of FIG. 1, the windows extend across the entire width of the cavity as measured in the first transverse direction Ox.

In known manner, each feed waveguide 24 has a first length 26 close to a microwave generator 22, a flared portion 28 that passes from the transverse dimensions of the first length 26 to the transverse size a of the cavity in the first transverse direction Ox, and a length 30 for connection to the housing 10.

The feed waveguide 24 has two side walls 24*a* and 24*b* substantially situated in the plane (Oy, Oz) except possibly in the flared portion 28. The waveguide 24 also includes a rear wall 24*c* and a front wall 24*d* that are respectively situated upstream and downstream in the wave propagation direction Oz. The front and rear walls are respectively connected to the front edge 32 and to the rear edge 34 of the corresponding window.

The feed waveguide 24 is associated with a guiding flap 36 that is more clearly visible in the cutaway portion of FIG. 1, which flap extends into the cavity 12 in the vicinity of the rear edge 34 of the corresponding window.

The waveguide 24 is also associated with a guide member 38 disposed on the inside face of the wall 10*b* of the cavity 12 opposite the first wall 10*a*. The guide member 38 is provided substantially facing the corresponding window and it is constituted by a metal part which co-operates with the guide flap to extend the wave orientation effect along the wall 10*b*, which effect is due both to said flap and to the curvature of the connection length of the feed waveguide.

Figure 3:
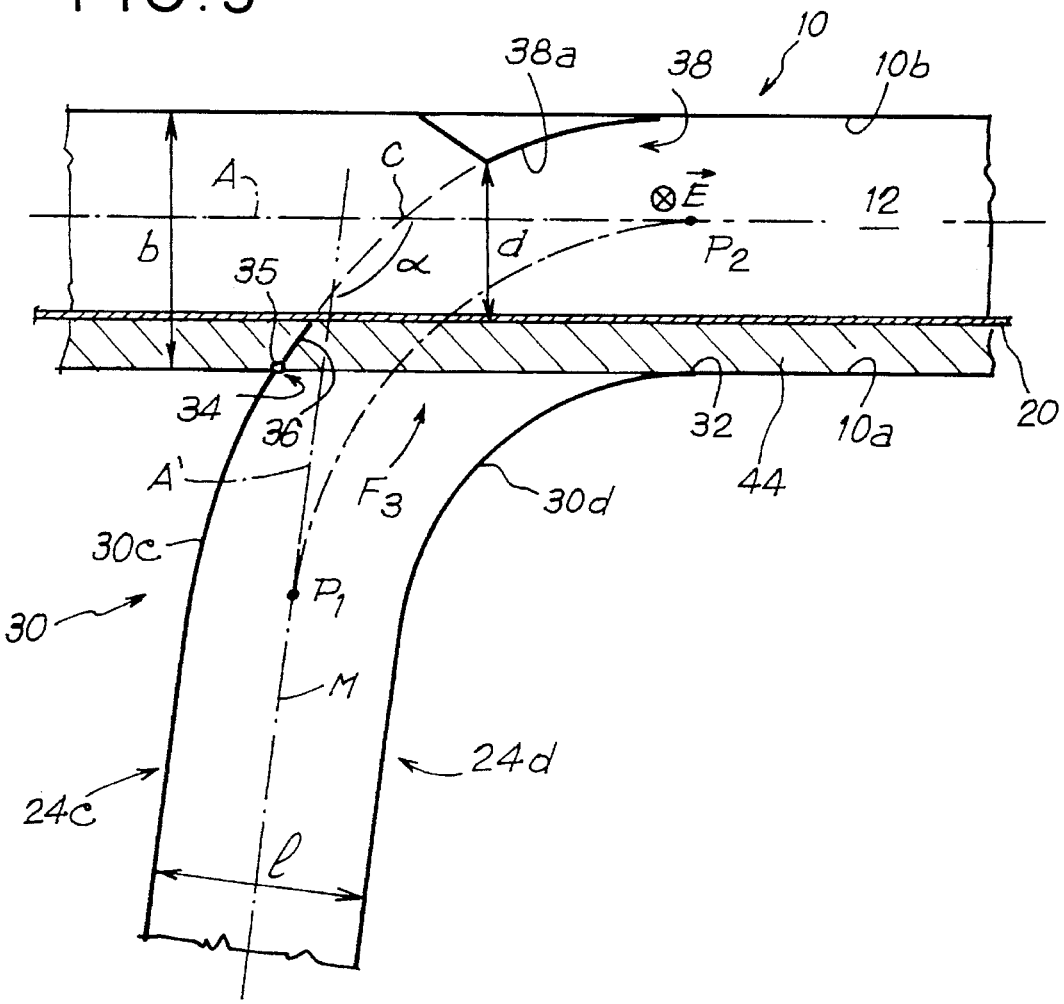
FIG. 3 is a section on line III—III of FIG. 2.

As can be seen more clearly in FIG. 3 (in which, to clarify the drawing, the elongate product to which the microwave are applied has been omitted), the front and rear walls of the feed waveguide 24 comprise, in the connection length 30, connection portions respectively designated by references 30*d* and 30*c* each of which curves forwardly substantially along a circular arc.

In FIG. 3, dot-dash lines represent the mean line M which corresponds to the midline in the feed waveguide 24 between the front and rear walls 24*d* and 24*c* of said waveguide (in the rectilinear portion of the waveguide, it coincides with the axis A' thereof), and which, from the first wall 10*a* of the housing 10, extends continuously so as finally to coincide with the longitudinal axis A of the housing.

Points $P_1$ and $P_2$ defining the curved portion of the mean line M and constitute points where said line moves away respectively from the axes A' and A.

Advantageously, the curvature of the front portion 30*d* and that of the rear portion 30*c* are chosen so that the length of the arc between the points $P_1$ and $P_2$ is substantially equal to an integer multiple of the half-wavelength of the wave propagating in the cavity 12.

Reference "1" designates the size of the rectilinear portion of the feed waveguide 24 along the axis Oz. Conventionally, this size is that of a standardized waveguide (e.g. 87 mm) and is constant in the portions 26 and 28 of the waveguide.

The size b of the housing 10 along the axis Oy is designed so as to maintain $TE_{01}$ mode guidance while nevertheless allowing elongate products to be treated whose transverse sections may reach a given maximum value.

This size b may be 115 mm, for example, and it may therefore be greater than the size "1".

The curvatures of the portions 30*c* and 30*d* are determined in such a manner that the transition between the sizes "1" and b takes place progressively.

Each of these two portions is substantially in the form of an arc of a circle and their respective centers of curvature are determined in appropriate manner.

Thus, the front connection portion 30*d* of the feed waveguide 24 is connected substantially tangentially to the first wall 10*a* of the cavity, whereas if the curvature of the rear connection portion 30*d* were extended inside the cavity it would connect substantially tangentially to the second wall 10*b*.

As can be seen in FIGS. 1 and 3, the guide flap 36 is situated substantially in line with the rear connection portion 30*c*. This means that no sharp angle appears in the region of the rear edge 34 of the window.

FIG. 3 shows connection window $F_n$ for the feed waveguide of excitation system $S_n$, however the same disposition is equally applicable to all of the other windows.

The, or each, excitation system includes means for adjusting wave coupling. These adjustment means are referenced 40 and 42 in FIG. 1. They are constituted, for example, by two plunger pistons provided in the first length 26 of the feed waveguide 24 and suitable for being engaged, independently of each other, to a greater or lesser extent inside said feed waveguide along the direction Ox so as to minimize the wave reflection coefficient.

As can be seen in FIG. 3, the guide flap 36 has curvature that matches that of the rear connection portion 30*c* of the feed waveguide. The radius of curvature of the flap 36 is substantially equal to the radius of curvature of the portion 30*c*.

The guide member 38 shown in the figures includes an active face 38*a* which, in the wave propagating direction, faces forwards. This active face 38*a* also has curvature that matches the curvature of the rear connection portion 30*c* of the feed waveguide 24.

As shown by dashed line C in FIG. 3, the guide flap 36 and the active face 38*a* of the guide member are substantially in continuity with the portion 30*c*.

Nevertheless, reference 35 in FIG. 3 shows that the orientation of the guide flap 36 relative to the first wall 10*a* of the cavity 12 can be adjusted. The same applies to the longitudinal position of the guide member 38.

Adjusting the inclination of the guide flap 36 consists in refining its angular position but does not alter the fact that the flap 36 remains substantially in line with the rear connection portion 30*c*.

Thus, when the device is installed, the position of the guide member 38 and the inclination of the guide flap 36 are determined in such a manner as to preserve the $TE_{01}$ propagation mode, and action is taken on the adjustment means 40 and 42 to obtain a minimum amount of reflection.

In FIG. 1, it can be seen that the rectilinear portions of the feed waveguides 24 extend along the axis Oy and consequently perpendicularly to the longitudinal direction Oz of the housing 10.

In the example of this figure, the coupling of the feed waveguides with the cavity 12 thus takes place at right angles.

In contrast, in the variant of FIG. 3, the angle α between the longitudinal axis of the cavity 12 and the axis A' of the rectilinear portions of the feed waveguide 24 is slightly greater than 90°.

This constitutes a disposition that is advantageous insofar as the coupling increases as the inclination of the feed waveguide approaches that of the longitudinal direction of the cavity.

In order to allow said inclination to remain compatible with the size of the system, the angle a must nevertheless not be too great.

The longitudinal ends 14 and 16 of the housing 12 shown in FIG. 1 have slots respectively designated by references 15 and 17.

The spacing e between the slots in the direction Oy is determined as a function of the transverse dimensions of the elongate products that are to be treated by means of the device.

In the example shown, the size of the slots in the direction Ox is substantially equal to the size a of the cavity 12. This presents an advantage when the elongate product to be treated is, for example, a section bar whose length is large and which runs the risk of buckling under the effect of the applied heat treatment, i.e. of deforming in the direction Ox. In addition, insofar as $TE_{01}$ propagation mode is preserved inside the cavity 12, even if the elongate product 18 does buckle under the effect of the heat treatment, the wave field that is applied thereto remains substantially constant over its entire length, since the field is constant in the Ox direction inside the cavity.

The slots 15 and 17 may be relatively large in size, and to avoid excessive energy losses, wave trap devices may be provided in the vicinity of said slots. One such trap device as associated with the slot 17 is shown diagrammatically in FIG. 1 and given references 17*a* and 17*b*.

The minimum distance d in the direction Oy between the guide flap 36 and the guide member 38 is preferably substantially equal to the spacing e of the slots. This distance d is greater than the maximum dimensions along the axis Oy of the guide flap 36 and of the guide member 38.

Figure 2:
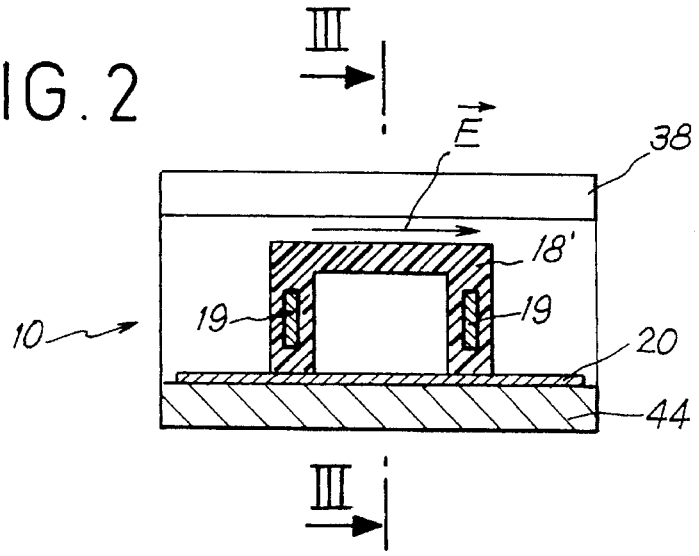
FIG. 2 is a section on line II—II of FIG. 1, showing a variant.

The sections of FIGS. 2 and 3 show a variant relative to the embodiment shown in perspective in FIG. 1. In these figures, it can be seen that the inside face of the first wall 10*a* of the cavity 12 is covered in a layer of dielectric material 44 in which the guide flap 36 is embedded. This layer of dielectric material 44 can thus serve as a support for the endless belt 40 which drives the elongate product to be treated without any risk of the belt catching in the guide flaps Alternatively or additionally, it is also possible 36. to provide for the inside face of the wall 10*b* of the cavity 12, i.e. the wall opposite the first wall 10*a*, to be covered in a layer of analogous dielectric material, in which the guide member 38 is embedded.

In a disposition that is upside-down relative to that shown in the figures, i.e. in which the excitation systems are placed above the housing, then this layer of dielectric material can also serve as a support for the means that drive the products to be treated.

As mentioned above, the device of the invention can be used to apply heat treatment to products such as section bars which have longitudinal dimensions that are particularly large, and under such circumstances the device may include a plurality of excitation systems $S_1$, $S_2$, $S_n$ that are similar to one another.

The first excitation system $S_1$ is placed in the immediate vicinity of the upstream longitudinal end 14 of the housing, while the last excitation system $S_n$ is placed near the other longitudinal end 16 at a distance therefrom that may correspond substantially to the attenuation distance of the waves.

Each excitation system includes a feed waveguide 24 as described above, and connected to the cavity 12 by a respective window.

Each feed waveguide 24 is thus associated with its own guide flap 36 and its own guide member 38.

The inclination of the flap 36 and the longitudinal position of the guide member 38 can be determined in such a manner that the wave continues to propagate in $TE_{01}$ mode, by avoiding the appearance of interference between the waves emitted by the various excitation systems that are disposed in series.

The windows $F_1$, $F_2$, and $F_n$ to which the feed waveguides of the systems $S_1$, $S_2$, and $S_n$ are respectively connected are formed through the first wall 10*a* of the cavity 12 at successive longitudinal positions in such a manner that the feed waveguides 24 of the various excitation systems are disposed in series.

The size of the guide flap(s) 36 and of the guide member(s) 38 in the first transverse direction Ox is substantially equal to the size of the cavity 12 in this direction.

The transverse dimensions a and b of the cavity 12 in the directions Ox and Oy respectively are determined as a function of the $TE_{01}$ propagation mode that is to be maintained within the cavity 12. The dimension a may or may not be greater than the dimension b.

When the dimension b is equal to 115 mm, the dimension a may thus be equal to 147 mm.

As mentioned above, the above-described device can be used to apply heat treatment continuously to an elongate product by means of microwaves.

When the treated elongate product is a section bar, the heat treatment may be used in a vulcanization process.

The elongate product 18' shown in section in FIG. 2 is of a special type that differs slightly from that shown in FIG. 1. It is a bar having metal inserts 19. Insofar as the $TE_{01}$ propagation mode is maintained inside the cavity, as indicated by the electric field E shown in FIG. 2, these metal inserts 19 do not constitute a source of disturbance to the heat treatment applied to the longitudinal product 18'.

We claim:

1. A microwave applicator device for continuous heat treatment of elongate products, the device comprising:

an applicator housing defining a rectangular waveguide cavity with open longitudinal ends enabling elongate products to pass therethrough;

drive means for driving said products along the longitudinal direction of the housing;

at least one excitation system for exciting said cavity with microwaves propagating in $TE_{01}$ transverse electric mode to create an electric field in said cavity and extending along a "first" one of the transverse directions of the cavity, said system including a microwave generator associated with a feed waveguide connected to the cavity via a window formed through a "first" wall of said cavity, said window extending parallel to the first transverse direction, said feed waveguide having two side walls, a rear wall, and a front wall;

the front and rear walls of the feed waveguide being respectively connected to the front and rear edges of the window;

the feed waveguide being associated with a guide flap extending inside the cavity in the vicinity of the rear edge of the window, and being associated with a guide member disposed on the inside face of the wall of the cavity opposite to said first wall and being located substantially facing the window;

the front and rear walls of the feed waveguide including respective front and rear connection portions situated in the connection zone for connection to the window, and each having forward curvature that is substantially in the form of an arc of a circle;

the guide flap being situated substantially in line with the rear connection portion; and the excitation system including means for adjusting coupling.

2. A device according to claim 1, wherein the guide flap has curvature that matches that of the rear connection portion of the feed waveguide.

3. A device according to claim 1 or 2, wherein the guide member includes an active face facing forwards and having curvature that matches that of the rear connection portion of the feed waveguide.

4. A device according to claim 1, wherein the front connection portion of the feed waveguide is connected substantially tangentially to the first wall of the cavity.

5. A device according to claim 1, wherein the longitudinal ends of the housing have slots at a determined spacing in the second transverse direction, and the minimum distance in said second direction between the guide flap and the guide member is substantially equal to said spacing.

6. A device according to claim 1, wherein the inside face of the first wall of the cavity is covered in a layer of dielectric material in which the guide flap is embedded.

7. A device according to claim 1, wherein the inside face of the wall of the cavity opposite to the first wall is covered on a layer of dielectric material in which the guide member is embedded.

8. A device according to claim 1, wherein the orientation of the guide flap relative to the first wall of the cavity and the longitudinal position of the guide member are adjustable.

9. A device according to claim 1, wherein the size of the cavity in the first transverse direction is greater than the size of said cavity in the second transverse direction.

10. A microwave applicator device for continuous heat treatment of elongate products, the device comprising:

an applicator housing defining a rectangular waveguide cavity with open longitudinal ends enabling elongate products to pass therethrough;

drive means for driving said products along the longitudinal direction of the housing;

a plurality of excitation systems for exciting said cavity with microwaves propagating in $TE_{01}$ transverse electric mode to create an electric field in said cavity and extending along a "first" one of the transverse directions of the cavity, said systems each including a microwave generator associated with a feed waveguide connected to the cavity via a window formed through a "first" wall of said cavity, said window extending parallel to the first transverse direction, each feed waveguide having two side walls, a rear wall, and a front wall;

each excitation system including means for adjusting coupling;

the feed waveguides of all the excitation systems being analogous;

the windows being formed in the first wall at successive longitudinal positions in such a manner that the feed waveguides are disposed in series;

the front and rear walls of each feed waveguide being respectively connected to the front and rear edges of the corresponding window;

each feed waveguide being associated with a guide flap extending inside the cavity in the vicinity of the rear edge of the corresponding window, and being associated with a guide member disposed on the inside face of the wall of the cavity opposite to said first wall and being located substantially facing said window;

the front and rear walls of each feed waveguide including respective front and rear connection portions situated in the connection zone for connection to the corresponding window, and each having forward curvature that is substantially in the form of an arc of a circle; and for each feed waveguide, the guide flap being situated substantially in line with the rear connection portion.

11. A device according to claim 10, wherein, for each feed waveguide, the guide flap has curvature that matches that of the rear connection portion of the feed waveguide.

12. A device according to claim 10 or 11, wherein, for each feed waveguide, the guide member includes an active face facing forwards and having curvature that matches that of the rear connection portion of the feed waveguide.

13. A device according to claim 10, wherein the front connection portion of each feed waveguide is connected substantially tangentially to the first wall of the cavity.

14. A device according to claim 10, wherein the longitudinal ends of the housing have slots at a determined spacing in the second transverse direction, and the minimum distance in said second direction between the guide flap and the guide member associated with each feed waveguide is substantially equal to said spacing.

15. A device according to claim 10, wherein the inside face of the first wall of the cavity is covered in a layer of dielectric material in which the guide flap is embedded.

16. A device according to claim 10, wherein the inside face of the wall of the cavity opposite to the first wall is covered on a layer of dielectric material in which the guide member is embedded.

17. A device according to claim 10, wherein, for each feed waveguide, the orientation of the guide flap relative to the first wall of the cavity and the longitudinal position of the guide member are adjustable.

18. A device according to claim 10, wherein the size of the cavity in the first transverse direction is greater than the size of said cavity in the second transverse direction.

* * * * *